US010465361B2

(12) United States Patent
Mairet et al.

(10) Patent No.: US 10,465,361 B2
(45) Date of Patent: Nov. 5, 2019

(54) PROPORTIONAL AUXILIARY FLOW ADJUSTMENT SYSTEM AND METHOD

(71) Applicant: DEERE & COMPANY, Moline, IL (US)

(72) Inventors: Sean A. Mairet, Dubuque, IA (US); Thomas J. Waller, Asbury, IA (US); Bryan Rausch, Durango, IA (US); Daniel A. Griswold, Bettendorf, IA (US)

(73) Assignee: DEERE & COMPANY, Moline, IL (US)

( * ) Notice: Subject to any disclaimer, the term of this patent is extended or adjusted under 35 U.S.C. 154(b) by 209 days.

(21) Appl. No.: 15/342,528

(22) Filed: Nov. 3, 2016

(65) Prior Publication Data

US 2018/0119712 A1 May 3, 2018

(51) Int. Cl.
*E02F 9/20* (2006.01)
*F15B 21/08* (2006.01)

(52) U.S. Cl.
CPC ..... *E02F 9/2025* (2013.01)

(58) Field of Classification Search
CPC .... F15B 21/02; F15B 21/087; F15B 13/0402; E02F 9/2025; E02F 9/2296
USPC ..... 60/459
See application file for complete search history.

(56) References Cited

U.S. PATENT DOCUMENTS

| | | | | |
|---|---|---|---|---|
| 8,387,289 | B2 | 3/2013 | Hanakawa et al. | |
| 8,589,026 | B2 | 11/2013 | Holt et al. | |
| 2015/0285241 | A1 | 10/2015 | Bang et al. | |
| 2016/0002017 | A1 | 1/2016 | Ueda et al. | |
| 2016/0091002 | A1* | 3/2016 | Miura | E02F 3/96 60/459 |

* cited by examiner

*Primary Examiner* — Michael Leslie
*Assistant Examiner* — Daniel S Collins
(74) *Attorney, Agent, or Firm* — Taft Stettinius & Hollister LLP; Stephen F. Rost

(57) ABSTRACT

An auxiliary flow adjustment system and method are disclosed for controlling an auxiliary hydraulic function on a machine in accordance with commands from an operator. The auxiliary flow adjustment system includes operator controls that control a hydraulic control valve. The control valve controls flow rate and flow direction to the auxiliary hydraulic function. When the auxiliary flow adjustment system is activated, the operator can use the operator controls to select a desired flow rate and flow direction for the auxiliary function and maintain the desired flow rate and direction without further use of the operator controls. When the flow adjustment system is activated while a non-zero flow rate is selected, the desired flow rate and direction can be set to the current settings. A resume control can retrieve and command the previously stored desired flow rate and direction. Controls can be used to increase and decrease the set flow rate.

20 Claims, 2 Drawing Sheets

PROPORTIONAL AUXILIARY FLOW ADJUSTMENT SYSTEM AND METHOD

FIELD OF THE DISCLOSURE

The present disclosure relates to hydraulic systems, and more particularly to a system and method to adjust hydraulic flow to an auxiliary function.

BACKGROUND

Many machines are equipped with hydraulic systems that can support auxiliary hydraulic functions, for example, skid steers, back hoes, loaders, etc. In some machines the operator controls auxiliary flow rate by constantly activating a roller to a desired position to maintain consistent flow to the auxiliary function. In other machines, the operator may also have an auxiliary extension control and an auxiliary retraction control that will send full or maximum hydraulic flow to the auxiliary hydraulic function in the designated direction. In some situations, the auxiliary function may not be able to handle the full or maximum hydraulic flow of the machine and thus the operator would be unable to use these full flow extension and retraction controls.

It would be desirable for an operator to be able to set and maintain a desired auxiliary flow rate and/or to resume a previously set auxiliary flow rate. It would be desirable for the operator to set a desired proportional flow rate setting between full extension or full retraction, for example, 20% flow rate, 50% flow rate, maintain current flow rate, resume last flow rate, etc.

SUMMARY

An auxiliary flow adjustment system is disclosed for controlling an auxiliary hydraulic function on a machine in accordance with commands from an operator. The auxiliary flow adjustment system includes operator controls, a machine controller and a hydraulic control valve. The operator controls accept operator commands for the auxiliary hydraulic function and generate operator control signals. The machine controller receives the operator control signals and generates auxiliary control signals based on the operator control signals. The hydraulic control valve receives the auxiliary control signals and controls flow rate and flow direction to the auxiliary hydraulic function based on the auxiliary control signals. When the auxiliary flow adjustment system is activated, the operator can use the operator controls to set a desired flow rate and a desired flow direction to the auxiliary hydraulic function and maintain the desired flow rate and the desired flow direction to the auxiliary hydraulic function without further use of the operator controls. The hydraulic control valve can include a spool valve where the spool is positioned based on the auxiliary control signals, and the flow rate and flow direction to the auxiliary hydraulic function can be controlled by the position of the spool.

The operator controls can include an activate/deactivate control, a flow rate control, and a flow direction control. The operator can activate and deactivate the auxiliary flow adjustment system using the activate/deactivate control. The operator can set flow rate to the auxiliary hydraulic function using the flow rate control. The operator can set flow direction to the auxiliary hydraulic function using the flow direction control. When the operator activates the auxiliary flow adjustment system using the activate/deactivate control while a non-zero flow rate is set with the flow rate control, then the desired flow rate can be set to the non-zero flow rate and the desired flow direction can be set to a current setting of the flow direction control.

The operator controls can also include a resume control, and the auxiliary flow adjustment system can store the desired flow rate and the desired flow direction. When the operator selects the resume control, the auxiliary flow adjustment system can retrieve the desired flow rate and the desired flow direction, and activate the machine controller to command the hydraulic control valve to provide flow to the auxiliary hydraulic function at the desired flow rate in the desired flow direction without operator control signals from the flow rate control or the flow direction control.

The flow rate control and the flow direction control can be implemented using a single flow control, where the single flow control includes a neutral position that indicates a zero flow rate, an extend maximum position and a retract maximum position. The single flow control can return to the neutral position when released by the operator. When the auxiliary flow adjustment system is deactivated, movement of the single flow control from the neutral position towards the extend maximum position by an operator selected extend movement between the neutral position and the extend maximum position can command a flow rate to the auxiliary hydraulic function in an extend direction based on the amount of movement of the single flow control in the extend direction. When the auxiliary flow adjustment system is deactivated, movement of the single flow control from the neutral position towards the retract maximum position by an operator selected retract movement between the neutral position and the retract maximum position can command a flow rate to the auxiliary hydraulic function in a retract direction based on the amount of movement of the single flow control in the retract direction.

When the operator activates the auxiliary flow adjustment system using the activate/deactivate control while the single flow control is in the neutral position, the auxiliary flow adjustment system can retrieve the desired flow rate and the desired flow direction, and activate the machine controller to command the hydraulic control valve to provide flow to the auxiliary hydraulic function at the desired flow rate in the desired flow direction.

When the auxiliary flow adjustment system is activated to maintain the desired flow rate and the desired flow direction, then movement of the single flow control in the extend direction can increment the desired flow rate to the auxiliary hydraulic function by a flow rate step and movement of the single flow control in the retract direction can decrement the desired flow rate to the auxiliary hydraulic function by the flow rate step.

When the auxiliary flow adjustment system is activated to maintain the desired flow rate and the desired flow direction, then movement of the single flow control in the extend direction can increase the desired flow to the auxiliary hydraulic function but not beyond a maximum flow rate and movement of the single flow control in the retract direction can decrease the desired flow to the auxiliary hydraulic function but not beyond a zero flow rate. Return of the single flow control to the neutral position can maintain the desired flow rate to the auxiliary hydraulic function at the last increased or decreased flow rate.

When the auxiliary flow adjustment system is activated to maintain the desired flow rate and the desired flow direction, then the auxiliary flow adjustment system can increase the desired flow rate to the auxiliary hydraulic function at an increase rate based on the amount of movement of the single flow control between the neutral position and the extend maximum position, and the auxiliary flow adjustment system can decrease the desired flow rate to the auxiliary hydraulic function at an decrease rate based on the amount of movement of the single flow control between the neutral position and the retract maximum position.

The operator controls can also include an increase flow control, and a decrease flow control. When the auxiliary flow adjustment system is activated to maintain the desired flow rate and the desired flow direction, then selection of the increase flow control can increase the desired flow rate to the auxiliary hydraulic function in the current flow direction, and selection of the decrease flow control can decrease the desired flow to the auxiliary hydraulic function in the current flow direction. Selection of the increase flow control can increment the desired flow rate to the auxiliary hydraulic function in the current flow direction by a flow rate step, and selection of the decrease flow control can decrement the desired flow rate to the auxiliary hydraulic function in the current flow direction by the flow rate step.

A method is disclosed for controlling an auxiliary flow adjustment system that controls flow to an auxiliary hydraulic function on a machine in accordance with commands from an operator. The method includes monitoring operator flow controls for operator selection of flow rate and direction to the auxiliary hydraulic function, the operator flow controls having a neutral position indicating no flow to the auxiliary hydraulic function; generating control signals based on the operator selection of flow rate and flow direction; controlling flow rate and flow direction to the auxiliary hydraulic function based on the control signals; sensing activation and deactivation of the auxiliary flow adjustment system; and when the auxiliary flow adjustment system is activated, maintaining a desired flow rate and a desired flow direction to the auxiliary hydraulic function without further use of the operator flow controls. The hydraulic control valve can include a spool, and controlling flow rate and direction to the auxiliary hydraulic function can include positioning the spool of the hydraulic control valve based on the control signals; and controlling flow rate and flow direction to the auxiliary hydraulic function based on the positioning of the spool.

The method can also include monitoring current operator selection of flow rate to the auxiliary hydraulic function; monitoring current operator selection of flow direction to the auxiliary hydraulic function; and when the auxiliary flow adjustment system is activated while a non-zero flow rate is selected by the operator flow controls, setting the desired flow rate to the non-zero flow rate, and setting the desired flow direction to a current operator selection of flow direction to the auxiliary hydraulic function.

The method can also include storing the desired flow rate and the desired flow direction; monitoring a resume control; and when the operator selects the resume control then retrieving the desired flow rate and the desired flow direction; setting hydraulic flow rate to the auxiliary hydraulic function to the desired flow rate; and setting hydraulic flow direction to the auxiliary hydraulic function to the desired flow direction.

The flow rate control and the flow direction control can be implemented using a single flow control, where the single flow control includes a neutral position indicating a zero flow rate, an extend maximum position and a retract maximum position. The single flow control can return to the neutral position when released by the operator. The method can also include monitoring movement of the single flow control by the operator. When the auxiliary flow adjustment system is deactivated and the single flow control is moved from the neutral position towards the extend maximum position, the method can also include sensing an amount of extend movement between the neutral position and the extend maximum position and commanding a flow rate to the auxiliary hydraulic function in an extend direction based on the sensed amount of the extend movement in the extend direction. When the auxiliary flow adjustment system is deactivated and the single flow control is moved from the neutral position towards the retract maximum position, the method can also include sensing an amount of retract movement between the neutral position and the retract maximum position and commanding a flow rate to the auxiliary hydraulic function in a retract direction at the sensed amount of the retract movement in the retract direction. The method can also include storing the desired flow rate and the desired flow direction; and when the operator activates the auxiliary flow adjustment system while the single flow control is in the neutral position then retrieving the desired flow rate and the desired flow direction; and commanding flow to the auxiliary hydraulic function at the desired flow rate in the desired flow direction.

The method can also include, when the auxiliary flow adjustment system is activated to maintain a desired flow rate and a desired flow direction, then when the single flow control is moved from the neutral position towards the extend maximum position, incrementing the desired flow rate to the auxiliary hydraulic function by a flow rate step; and when the single flow control is moved from the neutral position towards the retract maximum position, decrementing the desired flow rate to the auxiliary hydraulic function by the flow rate step.

The method can also include when the auxiliary flow adjustment system is activated to maintain a desired flow rate and a desired flow direction, then when the single flow control is moved from the neutral position towards the extend maximum position, increasing the desired flow rate to the auxiliary hydraulic function but not beyond a maximum flow rate; and when the single flow control is moved from the neutral position towards the retract maximum position, decreasing the desired flow rate to the auxiliary hydraulic function but not beyond a zero flow rate. The method can also include, when the single flow control returns to the neutral position, maintaining the desired flow rate to the auxiliary hydraulic function at the last increased or decreased flow rate.

The method can also include when the auxiliary flow adjustment system is activated to maintain a desired flow rate and a desired flow direction, then when the single flow control is moved from the neutral position towards the extend maximum position, sensing the amount of extend movement between the neutral position and the extend maximum position, and increasing the desired flow rate to the auxiliary hydraulic function at an increase rate based on the sensed amount of extend movement. The method can also include when the auxiliary flow adjustment system is activated to maintain a desired flow rate and a desired flow direction, then when the single flow control is moved from the neutral position towards the retract maximum position, then sensing the amount of retract movement between the neutral position and the retract maximum position, and decreasing the desired flow rate to the auxiliary hydraulic function at a decrease rate based on the sensed amount of retract movement.

The method can also include when the auxiliary flow adjustment system is activated to maintain the desired flow rate and the desired flow direction, monitoring an operator increase flow rate control; monitoring an operator decrease flow rate control; increasing the desired flow rate to the auxiliary hydraulic function in the current flow direction when the operator increase flow rate control is selected; and decreasing the desired flow rate to the auxiliary hydraulic function in the current flow direction when the operator decrease flow rate control is selected. The method can also include increasing the desired flow rate to the auxiliary hydraulic function in the current flow direction by a flow rate step when the operator increase flow rate control is selected; and decreasing the desired flow rate to the auxiliary hydraulic function in the current flow direction by the flow rate step when the operator decrease flow rate control is selected.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
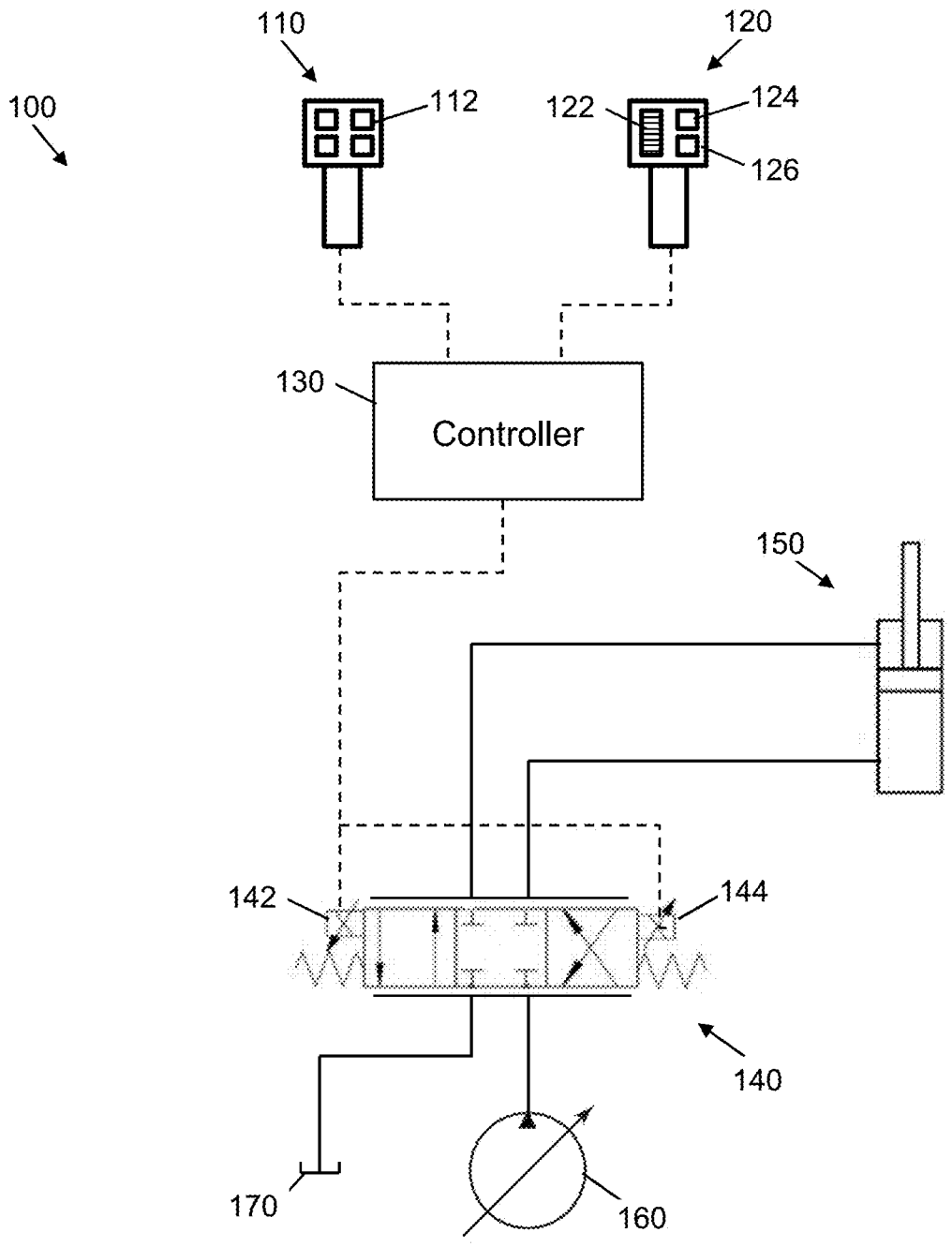
FIG. 1 illustrates an exemplary electrohydraulic system for a proportional auxiliary flow rate system.

FIG. 1 illustrates an example of an electrohydraulic system 100 for a proportional auxiliary flow rate system. The electrohydraulic system 100 includes operator controls 110, 120, a machine controller 130, an auxiliary hydraulic function 150 and an auxiliary hydraulic control valve 140. FIG. 1 represents a hydraulic source or pump 160 and a reservoir or tank 170 of the machine hydraulic system. In the embodiment shown in FIG. 1, the auxiliary hydraulic control valve 140 is shown as a proportional spool valve that includes an auxiliary extend solenoid 142 and an auxiliary retract solenoid 144 that can move the spool of the hydraulic control valve 140 based on signals from the controller 130 to control flow to extend and retract, respectively, the auxiliary hydraulic function 150. Those of skill in the art will understand that other types of control valves can also be used to control flow to extend and retract the auxiliary hydraulic function 150.

An operator uses the operator controls 110, 120 to send operator control signals to the controller 130. The controller 130 sends auxiliary control signals to the solenoids 142, 144 of the auxiliary hydraulic control valve 140 based on the operator control signals. The auxiliary extend and retract solenoids 142, 144 move the spool of the auxiliary hydraulic control valve 140 based on the auxiliary control signals to control the hydraulic flow rate and direction from the pump 160 of the machine hydraulic system to the auxiliary hydraulic function 150 to the tank 170.

FIG. 1 illustrates the operator controls 110, 120 as joysticks where the first operator control 110 has multiple buttons, including button 112 and the second operator control 120 includes a roller 122 and two buttons 124, 126. Those of skill in the art will understand that other types of operator controls known in the art could also be used to perform the functions described herein, for example toggle switches, dials, sliders, touch screens, etc.

In this example embodiment, the activation button 112 of the first operator control 110 is used to activate/deactivate the auxiliary flow adjustment system, and the roller 122 of the second operator control 120 represents the operator control that is used to select a desired flow rate and direction for the auxiliary hydraulic function 150. The operator can move the roller 122 a desired amount in a forward direction (away from the operator) or a reverse direction (towards the operator), and the roller 122 can be biased to return to a neutral center position when the operator releases the roller 122. The operator can move the roller 122 in the forward direction to send flow to extend the auxiliary function 150 by a variable amount determined by the amount the operator rotates the roller between the neutral position and the maximum forward position. The operator can move the roller 122 in the reverse direction to send flow to retract the auxiliary function 150 by a variable amount determined by the amount the operator rotates the roller between the neutral position and the maximum reverse position. As one example, if the operator moves the roller 20% forward between the neutral and maximum forward positions the flow rate can be set to 20% of maximum flow to extend; if 50% forward then 50% of maximum flow to extend; if 35% reverse then 35% of maximum flow to retract, etc.

The operator can set the current flow rate and direction for the auxiliary flow adjustment system 100 using the roller 122 as described above, and then push the activation button 112 to set the current flow rate and direction. After pushing the activation button 112, the operator can release the roller 122 which will return to its neutral position and the auxiliary flow adjustment system 100 will maintain the auxiliary hydraulic control valve 140 in its present position to maintain a constant flow rate and direction between the main hydraulic system of the machine and the auxiliary hydraulic function 150.

After the auxiliary flow adjustment system 100 has been activated to maintain an operator selected flow rate and direction between the main hydraulic system of the machine and the auxiliary hydraulic function 150, the auxiliary flow adjustment system 100 can enable the operator to increment or decrement the flow rate in the same flow direction.

In some embodiments, the roller 122 can be used to increment or decrement the flow rate. Moving the roller 122 in the forward direction can increment the flow rate and moving the roller 122 in the reverse direction can decrement the flow rate. The auxiliary flow adjustment system 100 can be designed so that the further the operator moves the roller in the forward or reverse directions, the faster the system 100 increments or decrements the flow rate to the auxiliary hydraulic function 150 until it reaches the maximum or minimum flow rate. The auxiliary flow adjustment system 100 can be designed so that as long as the operator keeps the roller in the forward or reverse direction, the system 100 continues to increment or decrement the flow rate to the auxiliary hydraulic function 150 until it reaches the maximum or minimum flow rate. The auxiliary hydraulic function 150 could have just one or both of these control features as well as others discussed herein. The auxiliary flow adjustment system 100 can be designed so that movement of the roller 122 in the forward or reverse direction only increments or decrements the flow rate to the auxiliary hydraulic function 150 by one flow rate step and the operator must allow the roller 122 to return to its neutral position and move the roller 122 again to increment or decrement the flow rate by another flow rate step.

In other embodiments, the buttons 124 and 126 can be used as an increment button 124 and a decrement button 126 to increment or decrement the flow rate to the auxiliary hydraulic function 150. Pressing the increment button 124 can increment the flow rate, and pressing the decrement button 126 can decrement the flow rate. The auxiliary flow adjustment system 100 can be designed so that as long as the operator keeps the increment button 124 pressed, the system 100 continues to increment the flow rate to the auxiliary hydraulic function 150 until it reaches the maximum flow rate. The auxiliary flow adjustment system 100 can be designed so that as long as the operator keeps the decrement button 126 pressed, the system 100 continues to decrement the flow rate to the auxiliary hydraulic function 150 until it reaches the minimum flow rate. The auxiliary flow adjustment system 100 can be designed so that pressing the increment button 124 only increments the flow rate to the auxiliary hydraulic function 150 by one flow rate step, and the operator must release the increment button 124 and press it again to increment the flow rate by another flow rate step. The auxiliary flow adjustment system 100 can be designed so that pressing the decrement button 126 only decrements the flow rate to the auxiliary hydraulic function 150 by one flow rate step, and the operator must release the decrement button 126 and press it again to decrement the flow rate by another flow rate step. The auxiliary hydraulic function 150 could have various combinations of these increment and decrement control features as well as others.

In different embodiments, the increment and decrement controls can have different functions depending on the flow direction setting. This can include the increment and decrement controls as described above, whether the roller 122 or the increment and decrement buttons 124, 126, or other increment and decrement controls. The increment and decrement controls can be configured such that the increment control always increases flow in the selected flow direction and the decrement control always decreases flow in the selected flow direction, whether the flow direction is to extend or retract the auxiliary hydraulic function 150. Alternatively, the increment and decrement controls can be configured similar to the extend and retract controls before activation of the auxiliary flow adjustment system 100. In this latter embodiment, when the selected flow direction is to extend the auxiliary hydraulic function 150, the increment control increases flow in the extend direction and the decrement control decreases flow in the extend direction. And, in this latter embodiment, when the selected flow direction is to retract the auxiliary hydraulic function 150, the increment control decreases flow in the retract direction and the decrement control increases flow in the retract direction.

After the auxiliary flow adjustment system 100 has been activated to maintain an operator selected flow rate and direction between the main hydraulic system of the machine and the auxiliary hydraulic function 150, the operator may have to temporarily discontinue use of the auxiliary hydraulic function 150. When the auxiliary flow adjustment system 100 is active, the operator can press the activation/deactivation button 112 again to deactivate the auxiliary flow adjustment system 100. As another example, the auxiliary flow adjustment system 100 may be deactivated if the operator moves the roller 122 in the forward or reverse direction beyond a threshold amount. In such an embodiment, the operator could increment and decrement the flow rate by moving the roller 122 forward or backward, respectively, less than the threshold amount, but deactivate the auxiliary flow adjustment system 100 by moving the roller 122 forward or backward more than the threshold amount.

The auxiliary flow adjustment system 100 can also provide a resume capability. After the auxiliary flow adjustment system 100 has been deactivated, the operator may want to resume use of the auxiliary hydraulic function 150 using the previously selected settings. The operator can press the activation/deactivation button 112 while the roller 122 is in the neutral position and the auxiliary flow adjustment system 100 can retrieve the previously set operator flow rate and direction settings and signal the controller 130 to send commands to the solenoids 142, 144 to move the auxiliary control valve 140 to the previously set position to resume the operator selected flow rate and direction from the main hydraulic system to the auxiliary hydraulic function 150. In other embodiments, other controls can be used to resume the auxiliary flow adjustment system 100 at the previously selected settings, for example pressing the increment button 124 to reactivate the auxiliary flow adjustment system 100 at the previously selected settings. Whenever the operator adjusts the flow rate or direction to the auxiliary hydraulic function 150, the auxiliary flow adjustment system 100 can store the new values for this resume capability. The auxiliary flow adjustment system 100 can be configured to erase the previously stored flow direction and rate values under certain circumstances, for example, a change in the auxiliary hydraulic function 150, powering down of the machine, etc.

Figure 2:
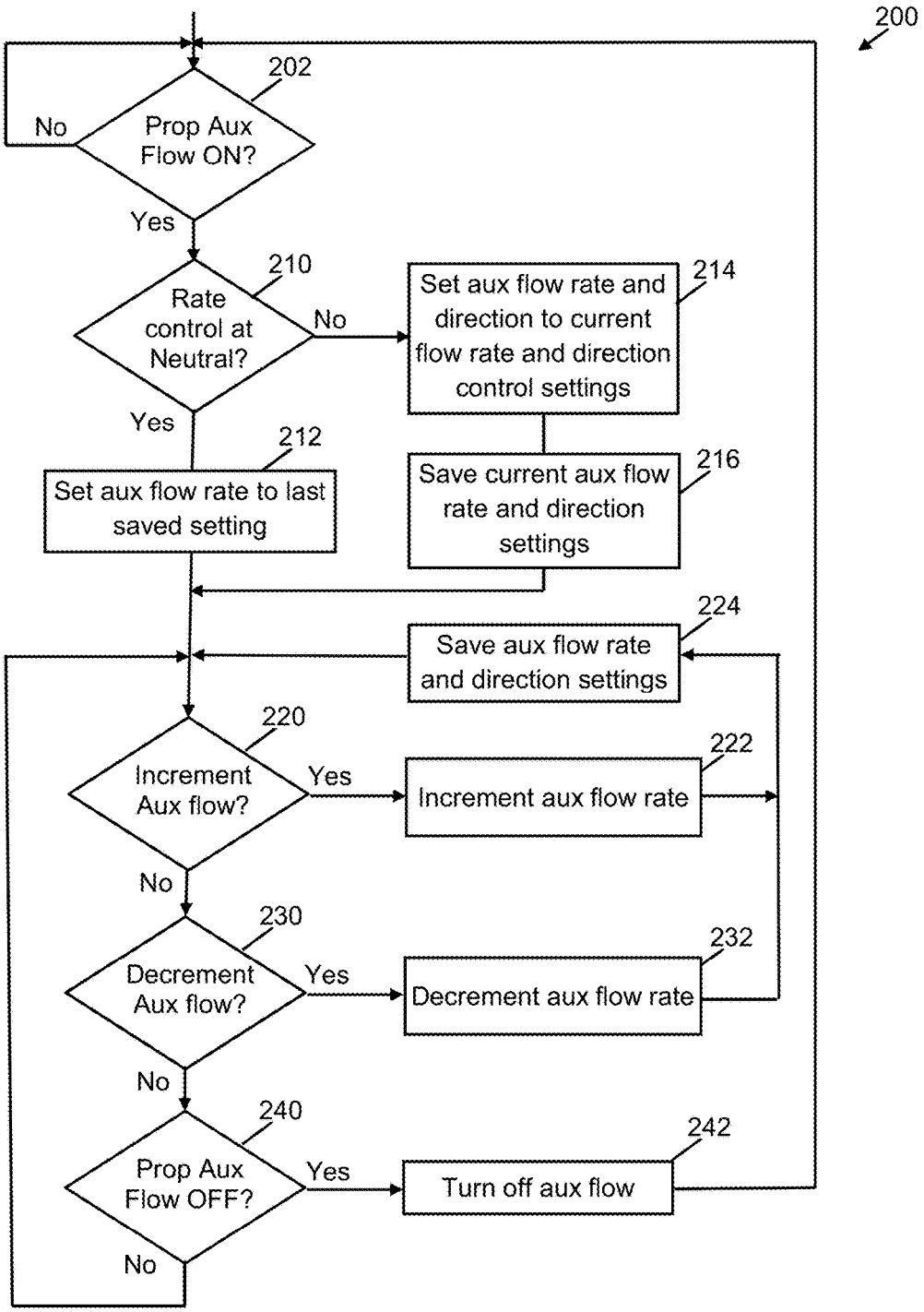
FIG. 2 illustrates an exemplary control flow for a proportional auxiliary flow rate system.

FIG. 2 shows an example of a general control flow 200 for an auxiliary flow adjustment system 100 having an activation/deactivation or on/off control, an increment control, a decrement control and a resume control. The following description will refer to the controls shown in FIG. 1, but other implementations can be used with a similar control flow.

At block 202 the system determines whether the auxiliary flow adjustment system 100 has been activated, for example by pressing the activation button 122. The system continues to wait at block 202 until the auxiliary flow adjustment system 100 is activated. When the auxiliary flow adjustment system 100 is activated, control proceeds to block 210.

At block 210 the system checks if the rate control, for example the roller 122, is in the neutral setting. This block checks for the resume condition versus activation of the auxiliary flow adjustment system at new flow rate and direction settings. Different embodiments with different resume and activation controls may require different control flows to distinguish between resume with previous settings and start with new settings. In this embodiment, if the rate control is in the neutral setting, then control proceeds to block 212 to resume flow to the auxiliary function 150 at previously set flow rate and direction settings. If the rate control is not in the neutral setting, then control proceeds to block 214 to maintain flow to the auxiliary function 150 at the currently set flow rate and direction settings.

At block 212, the system retrieves the previously set flow rate and direction settings, and commands the auxiliary flow valve 140 to these previous settings to resume operation of the auxiliary function 150 at these settings. From block 212, control proceeds to block 220.

At block 214, the system sets the auxiliary flow rate and direction settings to the currently set values, for example by the current position of the roller 122. This allows the operator to release the roller 122 and let the auxiliary flow adjustment system 100 maintain the current auxiliary flow rate and direction settings, for example by maintaining the auxiliary control valve 140 in its current position. Then at block 216, the system saves the current auxiliary flow rate and direction settings which can be used for a later resume operation. From block 216, control proceeds to block 220.

At block 220, the system checks for an increment auxiliary flow command, for example forward movement of the roller 122 or pressing of the increment button 124. If the increment auxiliary flow command is not activated, then control proceeds to block 230. If the increment auxiliary flow command is activated, then at block 222, the system signals the controller 130 to send a signal to one of the solenoids 142, 144 to increment the flow rate through the auxiliary control valve 140 to the auxiliary hydraulic function 150. From block 222, control proceeds to block 224.

At block 230, the system checks for a decrement auxiliary flow command, for example reverse movement of the roller 122 or pressing of the decrement button 126. If the decrement auxiliary flow command is not activated, then control proceeds to block 240. If the decrement auxiliary flow command is activated, then at block 232, the system signals the controller 130 to send a signal to the other of the solenoids 142, 144 to decrement the flow rate through the auxiliary control valve 140 to the auxiliary hydraulic function 150. From block 232, control proceeds to block 224.

At block 240, the system checks whether the auxiliary flow adjustment system 100 has been deactivated, for example by pressing the activation button 122 again. If the decrement auxiliary flow command is not activated, then control proceeds to block 242. If the auxiliary flow adjustment system 100 has not been deactivated, then control proceeds to block 220. If the auxiliary flow adjustment system 100 has been deactivated, then at block 242 the system signals the controller 130 to send signals to the solenoids 142, 144 to release the auxiliary control valve 140 to the neutral position and return to operator control of the auxiliary hydraulic function 150 without the auxiliary flow adjustment system 100. From block 242, control proceeds to block 202 to wait for the auxiliary flow adjustment system 100 to be reactivated.

At block 224 the system saves the incremented or decremented flow rate settings and control proceeds to block 220.

While the disclosure has been illustrated and described in detail in the drawings and foregoing description, such illustration and description is to be considered as exemplary and not restrictive in character, it being understood that illustrative embodiment(s) have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

We claim:

1. An auxiliary flow adjustment system for controlling an auxiliary hydraulic function on a machine in accordance with commands from an operator, the auxiliary flow adjustment system comprising:

operator controls that accept operator commands for the auxiliary hydraulic function and generate operator control signals for a current operator selected flow rate and a current operator selected flow direction, wherein the operator controls include a neutral position that indicates a zero flow rate and the operator controls return to the neutral position when released by the operator;

a machine controller that receives the operator control signals and generates auxiliary control signals based on the operator control signals; and a hydraulic control valve that receives the auxiliary control signals and controls flow rate and flow direction to the auxiliary hydraulic function based on the auxiliary control signals;

wherein when the auxiliary flow adjustment system is activated while the current operator selected flow rate is a non-zero flow rate, the operator controls are configured to set a desired flow rate equal to the current operator selected flow rate, and to set a desired flow direction equal to the current operator selected flow direction to the auxiliary hydraulic function, and to maintain the desired flow rate and the desired flow direction to the auxiliary hydraulic function when the operator controls are released by the operator.

2. The auxiliary flow adjustment system of claim 1, wherein the hydraulic control valve comprises a spool that is positioned based on the auxiliary control signals, where the flow rate and flow direction to the auxiliary hydraulic function are controlled by the position of the spool.

3. An auxiliary flow adjustment system for controlling an auxiliary hydraulic function on a machine in accordance with commands from an operator, the auxiliary flow adjustment system comprising:

operator controls that accept operator commands for the auxiliary hydraulic function and generate operator control signals, wherein the operator controls comprise:

an activate/deactivate control;

a flow rate control; and a flow direction control;

a machine controller that receives the operator control signals and generates auxiliary control signals based on the operator control signals; and a hydraulic control valve that receives the auxiliary control signals and controls flow rate and flow direction to the auxiliary hydraulic function based on the auxiliary control signals;

wherein when the auxiliary flow adjustment system is activated, the operator controls are configured to set a desired flow rate and a desired flow direction to the auxiliary hydraulic function and maintain the desired flow rate and the desired flow direction to the auxiliary hydraulic function without further use of the operator controls; and wherein the operator activates and deactivates the auxiliary flow adjustment system with the activate/deactivate control, the operator sets flow rate to the auxiliary hydraulic function with the flow rate control, the operator sets flow direction to the auxiliary hydraulic function with the flow direction control, and when the operator activates the auxiliary flow adjustment system with the activate/deactivate control while a non-zero flow rate is set with the flow rate control, then the desired flow rate is set to the non-zero flow rate and the desired flow direction is set to a current setting of the flow direction control.

4. The auxiliary flow adjustment system of claim 3, wherein the operator controls further comprise a resume control and the auxiliary flow adjustment system stores the desired flow rate and the desired flow direction;

wherein when the operator selects the resume control, the auxiliary flow adjustment system retrieves the desired flow rate and the desired flow direction, and the machine controller generates the auxiliary control signals to position the hydraulic control valve to provide flow to the auxiliary hydraulic function at the desired flow rate in the desired flow direction without operator control signals from the flow rate control or the flow direction control.

5. The auxiliary flow adjustment system of claim 3, wherein the flow rate control and the flow direction control are implemented with a single flow control, the single flow control includes a neutral position that indicates a zero flow rate, an extend maximum position and a retract maximum position, and the single flow control returns to the neutral position when released by the operator;

wherein when the auxiliary flow adjustment system is deactivated, movement of the single flow control from the neutral position towards the extend maximum position by an operator selected extend movement between the neutral position and the extend maximum position commands an extend flow rate to the auxiliary hydraulic function in an extend direction, and wherein when the auxiliary flow adjustment system is deactivated, movement of the single flow control from the neutral position towards the retract maximum position by an operator selected retract movement between the neutral position and the retract maximum position commands a retract flow rate to the auxiliary hydraulic function in a retract direction.

6. The auxiliary flow adjustment system of claim 5, wherein the auxiliary flow adjustment system stores the desired flow rate and the desired flow direction; and wherein when the operator activates the auxiliary flow adjustment system with the activate/deactivate control while the single flow control is in the neutral position, the auxiliary flow adjustment system retrieves the desired flow rate and the desired flow direction, and the machine controller generates the auxiliary control signals to position the hydraulic control valve to provide flow to the auxiliary hydraulic function at the desired flow rate in the desired flow direction.

7. The auxiliary flow adjustment system of claim 6, wherein when the auxiliary flow adjustment system is activated to maintain the desired flow rate and the desired flow direction then movement of the single flow control in the extend direction increments the desired flow rate to the auxiliary hydraulic function by a flow rate step in the desired flow direction and movement of the single flow control in the retract direction decrements the desired flow rate to the auxiliary hydraulic function in the desired flow direction by the flow rate step.

8. The auxiliary flow adjustment system of claim 6, wherein when the auxiliary flow adjustment system is activated to maintain the desired flow rate and the desired flow direction then movement of the single flow control in the extend direction increases the desired flow rate to the auxiliary hydraulic function in the desired flow direction but not beyond a maximum extend flow rate and movement of the single flow control in the retract direction decreases the desired flow rate to the auxiliary hydraulic function in the desired flow direction but not beyond a zero extend flow rate; and wherein return of the single flow control to the neutral position maintains the desired flow rate to the auxiliary hydraulic function at the last increased or decreased flow rate.

9. The auxiliary flow adjustment system of claim 5, wherein the operator controls further comprise:

an increase flow control; and a decrease flow control; and wherein selection of the increase flow control increases the desired flow rate to the auxiliary hydraulic function in the current flow direction, and selection of the decrease flow control decreases flow to the auxiliary hydraulic function in the current flow direction.

10. The auxiliary flow adjustment system of claim 9, wherein selection of the increase flow control increments flow to the auxiliary hydraulic function in the current flow direction by a flow rate step, and selection of the decrease flow control decrements flow to the auxiliary hydraulic function in the current flow direction by the flow rate step.

11. A method for controlling an auxiliary flow adjustment system that controls flow to an auxiliary hydraulic function on a machine in accordance with commands from an operator, the method comprising:

monitoring operator flow controls for operator selection of flow rate and direction to the auxiliary hydraulic function, the operator flow controls having a neutral position indicating no flow to the auxiliary hydraulic function;

monitoring a current operator selection of flow rate to the auxiliary hydraulic function;

monitoring a current operator selection of flow direction to the auxiliary hydraulic function;

generating control signals based on the operator selection of flow rate and direction;

controlling flow rate and direction to the auxiliary hydraulic function based on the control signals;

sensing activation and deactivation of the auxiliary flow adjustment system; and when the auxiliary flow adjustment system is activated, maintaining a desired flow rate and a desired flow direction to the auxiliary hydraulic function without further use of the operator flow controls; and when the auxiliary flow adjustment system is activated while the current operator selection of flow rate is a non-zero flow rate, setting the desired flow rate to the current operator selection of flow rate, and setting the desired flow direction to the current operator selection of flow direction.

12. The method of claim 11, further comprising:

storing the desired flow rate and the desired flow direction;

monitoring a resume control;

when the operator selects the resume control:

retrieving the desired flow rate and the desired flow direction;

setting hydraulic flow rate to the auxiliary hydraulic function to the desired flow rate; and setting hydraulic flow direction to the auxiliary hydraulic function to the desired flow direction.

13. The method of claim 11, wherein the flow rate control and the flow direction control are implemented using a single flow control, the single flow control having a neutral position indicating a zero flow rate, an extend maximum position and a retract maximum position, the single flow control returning to the neutral position when released by the operator; the method further comprising:

monitoring movement of the single flow control by the operator;

when the auxiliary flow adjustment system is deactivated and the single flow control is moved from the neutral position towards the extend maximum position, commanding a flow rate to the auxiliary hydraulic function in an extend direction based on an amount of movement of the single flow control in the extend direction, and when the auxiliary flow adjustment system is deactivated and the single flow control is moved from the neutral position towards the retract maximum position, commanding a flow rate to the auxiliary hydraulic function in a retract direction based on an amount of movement of the single flow control in the retract direction.

14. The method of claim 13, further comprising:

storing the desired flow rate and the desired flow direction; and when the operator activates the auxiliary flow adjustment system while the single flow control is in the neutral position:

retrieving the desired flow rate and the desired flow direction; and commanding flow to the auxiliary hydraulic function at the desired flow rate in the desired flow direction.

15. The method of claim 14, further comprising:

when the auxiliary flow adjustment system is activated to maintain the desired flow rate and the desired flow direction:

when the single flow control is moved from the neutral position towards the extend maximum position, incrementing the desired flow rate to the auxiliary hydraulic function by a flow rate step; and when the single flow control is moved from the neutral position towards the retract maximum position, decrementing the desired flow rate to the auxiliary hydraulic function by the flow rate step.

16. The method of claim 14, further comprising:

when the auxiliary flow adjustment system is activated to maintain the desired flow rate and the desired flow direction:

when the single flow control is moved from the neutral position towards the extend maximum position, increasing the desired flow to the auxiliary hydraulic function but not beyond a maximum flow rate; and when the single flow control is moved from the neutral position towards the retract maximum position, decreasing the desired flow rate to the auxiliary hydraulic function but not beyond a zero flow rate;

when the single flow control returns to the neutral position, maintaining the desired flow rate to the auxiliary hydraulic function at the last increased or decreased flow rate.

17. The method of claim 13, further comprising when the auxiliary flow adjustment system is activated to maintain the desired flow rate and the desired flow direction:

monitoring an operator increase flow rate control;

monitoring an operator decrease flow rate control;

increasing the desired flow rate to the auxiliary hydraulic function in the current flow direction when the operator increase flow rate control is selected; and decreasing the desired flow rate to the auxiliary hydraulic function in the current flow direction when the operator decrease flow rate control is selected.

18. The method of claim 17, further comprising:

increasing the desired flow rate to the auxiliary hydraulic function in the current flow direction by a flow rate step when the operator increase flow rate control is selected; and decreasing the desired flow rate to the auxiliary hydraulic function in the current flow direction by the flow rate step when the operator decrease flow rate control is selected.

19. The auxiliary flow adjustment system of claim 1, wherein the operator controls further comprise a resume control and the auxiliary flow adjustment system stores the desired flow rate and the desired flow direction;

wherein when the operator selects the resume control, the auxiliary flow adjustment system retrieves and generates operator control signals for the desired flow rate and the desired flow direction, and the machine controller generates the auxiliary control signals for the hydraulic control valve to provide flow to the auxiliary hydraulic function at the desired flow rate in the desired flow direction.

20. The auxiliary flow adjustment system of claim 1, wherein the operator controls further comprise:

an increase flow control; and a decrease flow control; and wherein selection of the increase flow control increases the desired flow rate to the auxiliary hydraulic function in the current flow direction, and selection of the decrease flow control decreases flow to the auxiliary hydraulic function in the current flow direction.

* * * * *